US006536053B2

(12) United States Patent
Icking et al.

(10) Patent No.: US 6,536,053 B2
(45) Date of Patent: Mar. 25, 2003

(54) FLUSH CONTROL APPARATUS

(75) Inventors: Thomas Icking, Rauma (FI); Janne Rautavuori, Lappi (FI)

(73) Assignee: Oras Oy, Rauma (FI)

( * ) Notice: Subject to any disclaimer, the term of this patent is extended or adjusted under 35 U.S.C. 154(b) by 0 days.

(21) Appl. No.: 10/076,392

(22) Filed: Feb. 19, 2002

(65) Prior Publication Data

US 2002/0116754 A1 Aug. 29, 2002

(30) Foreign Application Priority Data

Feb. 19, 2001 (FI) ..... 20010310

(51) Int. Cl.[7] ..... E03D 1/36
(52) U.S. Cl. ..... 4/367; 4/406
(58) Field of Search ..... 4/366, 367, 406, 4/407, 390

(56) References Cited

U.S. PATENT DOCUMENTS 4,230,145 A * 10/1980 Badders ..... 137/410
5,652,970 A * 8/1997 Wodeslavsky ..... 4/378

* cited by examiner

*Primary Examiner*—Robert M. Fetsuga
*Assistant Examiner*—Amanda Flynn
(74) *Attorney, Agent, or Firm*—Young & Thompson

(57) ABSTRACT

An apparatus for flushing a WC bowl, the apparatus allowing reflushing of the bowl soon after the first flushing without filling the water tank to the maximum volume determined by an electric sensor. The movement of a piston part (4) located in a chamber (5) communicating with the water distribution system is controlled by a control mechanism (2) operating under the dynamic pressure of supply water and by the force of gravity, this movement, in turn, controlling the movement of the discharge valve (15) and thus regulating the flushing step.

4 Claims, 4 Drawing Sheets

FLUSH CONTROL APPARATUS

Figure 1:
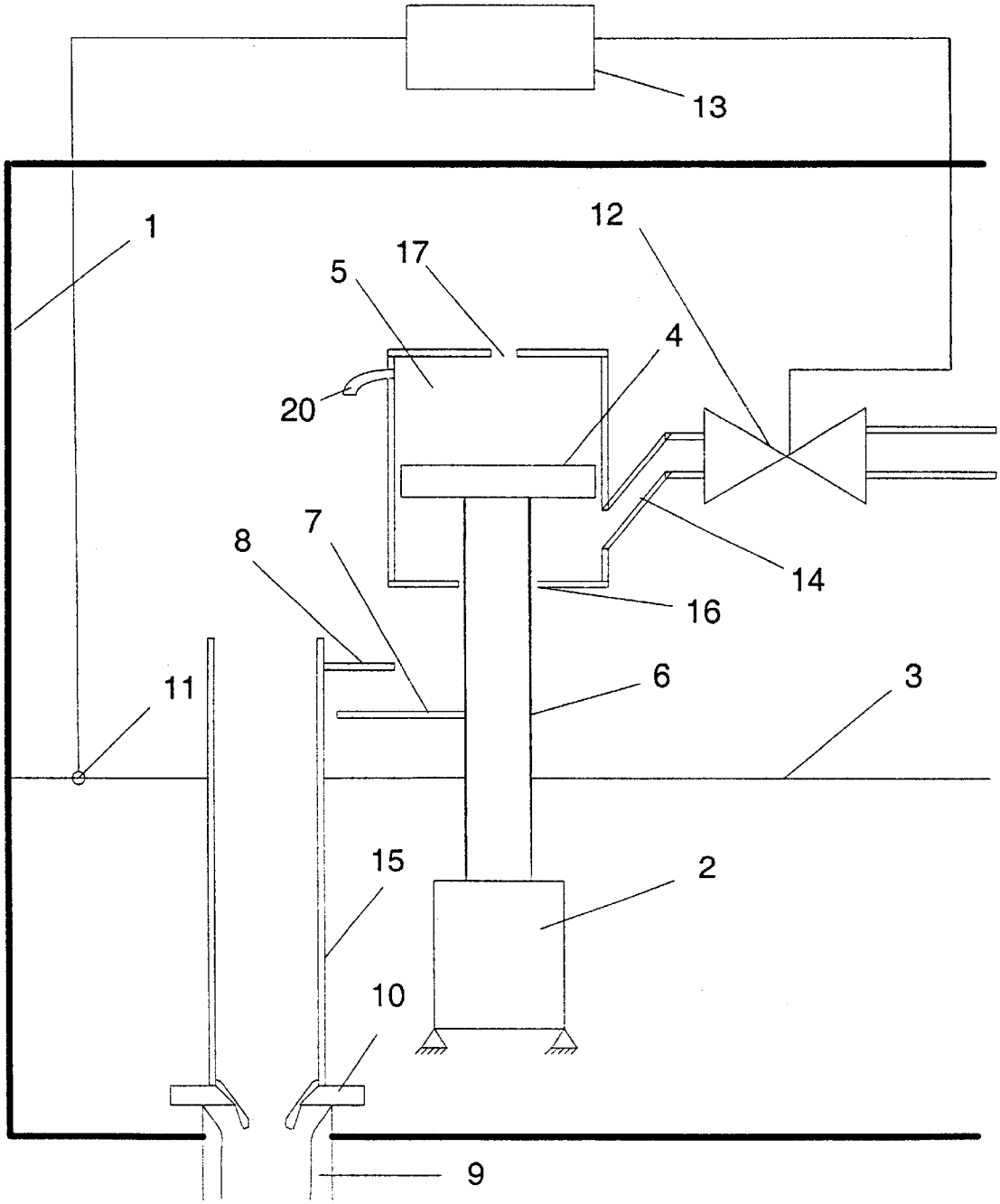

This invention relates to an apparatus for flushing a toilet bowl or the like. The apparatus controls the amount of water used for flushing, which enters the water tank through a valve from the water distribution system and is discharged through the discharge pipe, allowing the bowl to be flushed again soon after the first flushing without the water tank having to been filled to the maximum volume determined by an electric sensor.

The operation of current systems involves the control of the water level in the tank by means of two separate apparatuses. The inlet valve is opened each time the water level sinks below a determined level, allowing additional water to enter the tank from the water distribution system, until the predetermined water level is reached, whereby the valve is closed. The water level is monitored and the inlet valve is opened and closed mechanically by means of a float. To control the water level and consequently the amount of flush water used, the cover of the water tank must be removed and the operation of the float controlled.

The discharge valve is mechanically opened in that the user acts to release either one or both of the superposed pairs of floats controlling the discharge function. This method allows regulation of the flush water in a larger or smaller amount and reduction of unnecessary water consumption. Yet there are only two options of water amounts to be used. As the water level has sunk in the tank to the level adjusted by the float, the end of the discharge pipe is closed and the tank starts filling again.

Our previous FI Patent Application 20001337, which we incorporate as a reference, discloses an apparatus used for the flushing of a WC bowl or the like, which allows stepless and easy control of the amount of flush water, without opening the WC bowl cover, even with different water amounts each time the bowl is flushed, if desired. In the invention of FI patent application 20001337, the apparatus comprises, besides the device for turning on and off supply water, for instance a solenoid, notably fewer moving parts than commonly known solutions. The apparatus used for flushing a WC bowl of FI 20001337 is characterized by the fact that the amount of flush water is electrically controlled and can be steplessly adjusted on the basis of the flushing time using one single control valve. As control valve, any electrically controllable valve is usable, for instance a solenoid valve, and the stepless adjustment of the flush water is performed by electric means from the outside of the water tank, using any commonly known electric control unit used for valve adjustment.

The flushing system of our previously known FI Patent Application 20001337 has the drawback that, should the user wish to flush the WC bowl again immediately or soon after the first flush, he will have to wait until the tank is totally refilled and ready for flushing. Flushing cannot be carried out while the tank is still in the course of being filled.

The purpose of the present invention is to provide an apparatus used for flushing a WC bowl or the like, which allows the amount of flush water to be steplessly and easily regulated, and the bowl to be flushed again soon after the first flush, without the water tank having to be filled to the volume determined by the electric sensor.

This has been achieved in the manner defined in the characterizing part of claim 1.

Figure 2:
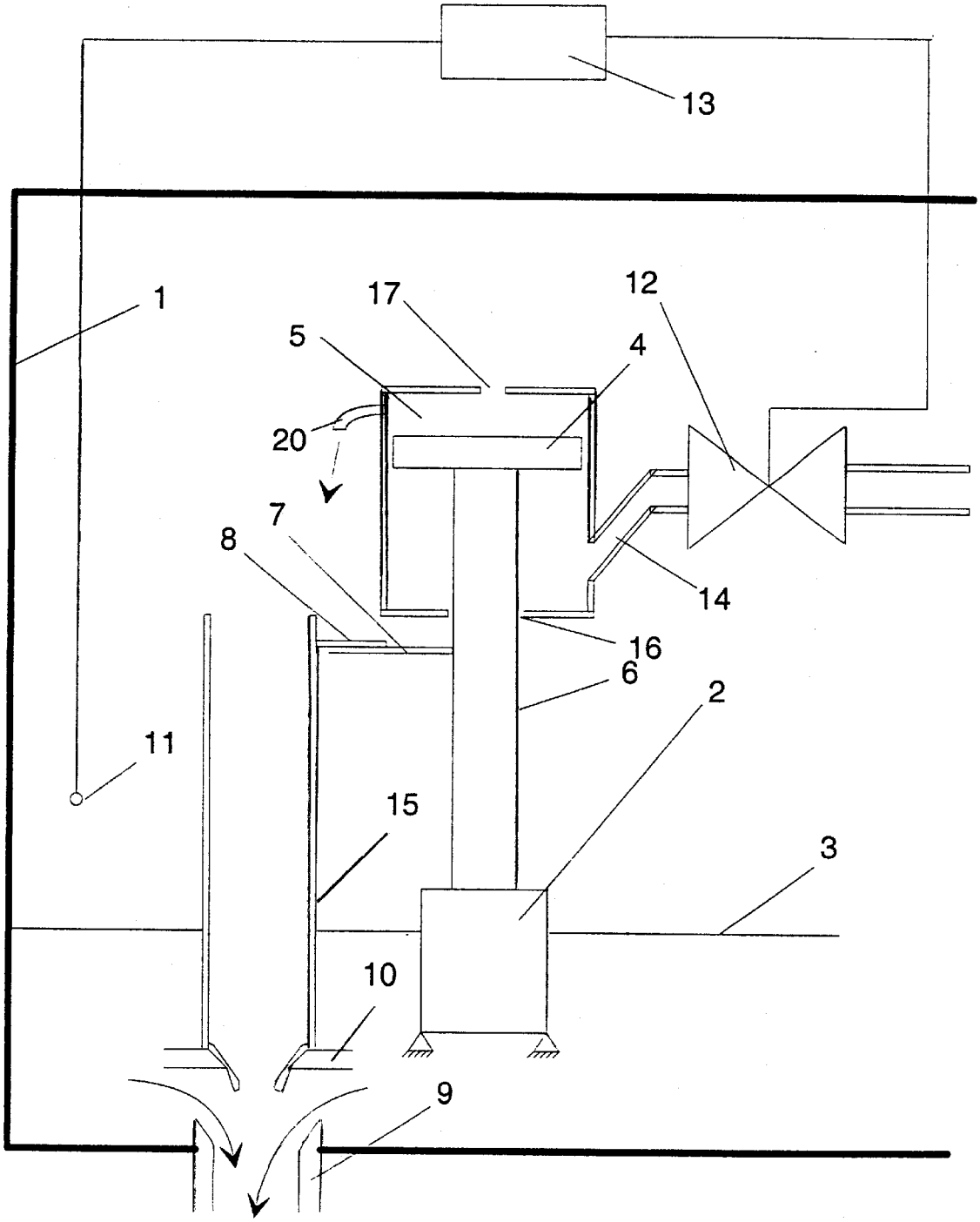
Figure 3:
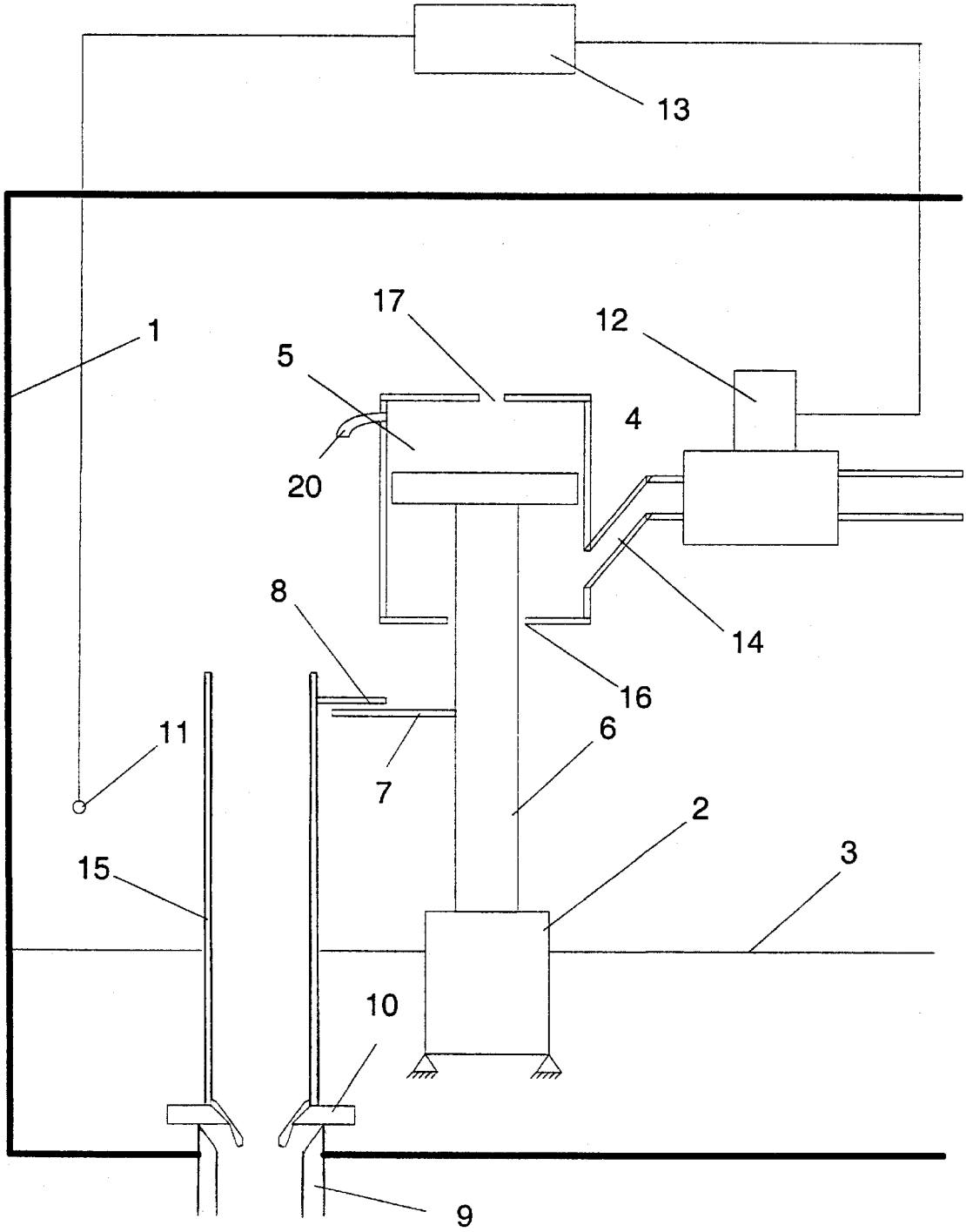
Figure 4:
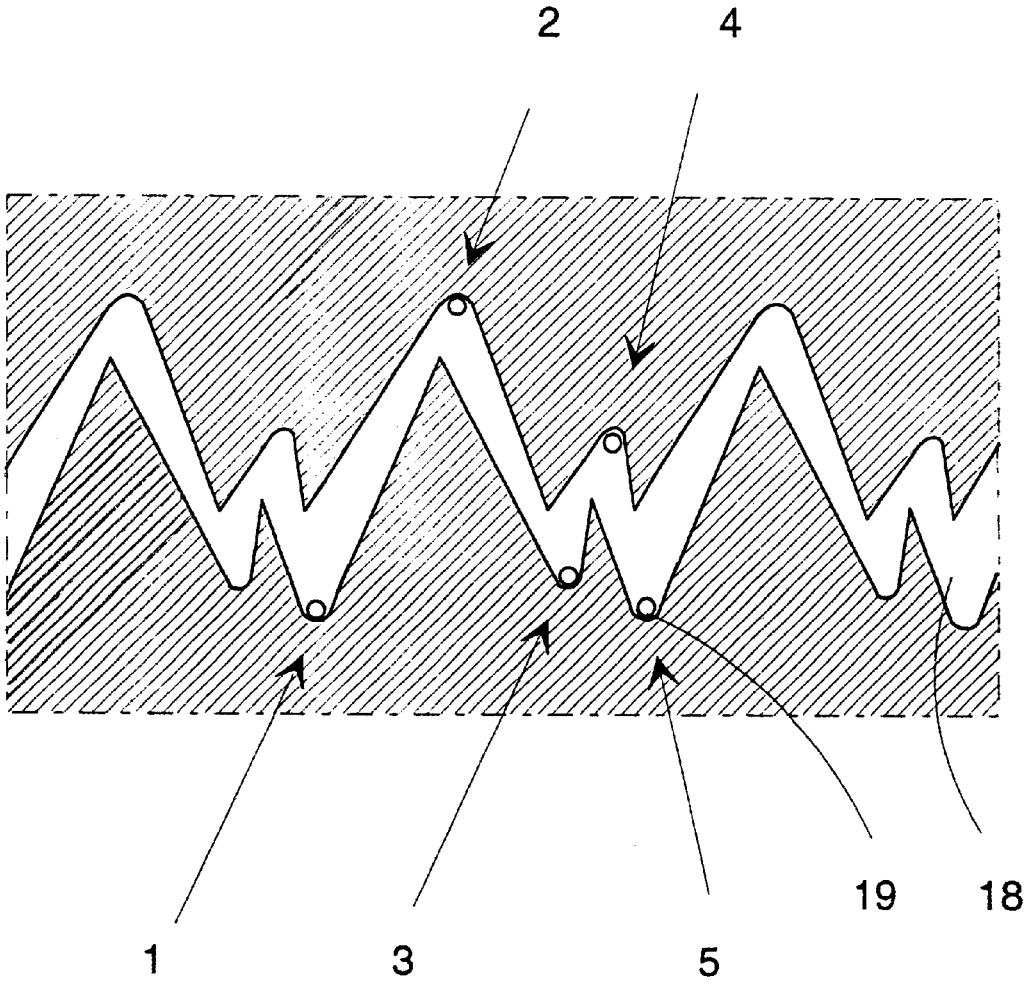

The invention is described below with reference to the accompanying drawings, in which FIG. 1 shows a filled water tank ready for flushing, FIG. 2 shows the water tank during flushing, FIG. 3 shows the water tank while being filled, FIG. 4 illustrates the operating principle of the control mechanism.

FIG. 1 shows an apparatus of the invention, comprising a water tank 1, an inlet valve 12, a discharge valve 15, and an actuating mechanism. The actuating mechanism consists of a chamber 5, which may be for instance circular, rectangular or square in cross-section. However, it is preferably cylindrical. The chamber 5 communicates with the water distribution system over an inlet pipe 14.

A substantially vertical shaft 6 passes through the chamber 5, preferably through its bottom. A piston part 4 controlled by a control mechanism 2 and rising and sinking under the dynamic pressure of supply water in the chamber is fastened to the shaft. The piston part 4 is composed of e.g. a plate-like part, which surrounds the shaft 6 like a collar. The piston part may be bevelled downwardly or horizontal relative to the shaft, or shaped in any other suitable manner. The lower edge of the piston part 4 is always located above the inlet pipe 14. The piston part 4 extends from the shaft to the vicinity of the wall of the chamber 5, leaving a gap between the edge of the plate-like part of the piston part and the inner surface of the chamber, allowing thus the piston part to move freely within the chamber.

A positionary control mechanism 2 is provided at the lower end of the shaft 6 or in its vicinity to guide the vertical movement of the shaft and the associated piston part 4. Below the bottom of the chamber 5, the shaft 6 comprises a counter-part 7, which may be for instance a pin fastened transversely to the shaft or the end of a vertical upwardly extending groove. The counter-part 7 bears against a counter-part 8 located at the upper portion of the body of a hollow, preferably cylindrical discharge valve 15. The counter-part 8 may be e.g. a transverse pin fastened to the body of the discharge valve 15, or the end of the downwardly extending vertical groove. If a pin is used for both the counter-parts 7 and 8, the pins must have the correct shape to make sure that they match. One of them may be round and the other one plate-like, for instance. At the lower edge of the discharge valve 15, a gasket 10 is provided between the water outlet pipe 9 and the discharge valve 15. The end of the discharge pipe 9 is opened when the discharge valve 15 is lifted. A water gauge or control based on the opening period of the inlet and outlet valves can be used to control the amount of water in the water tank 1. However, this control is preferably carried out by means of an electric sensor 11.

The control mechanism 2 comprises for instance a cylinder or some other body, within which a mechanical endless path 18, as for instance a groove has been formed, a pin 19 or any other projection located at the lower end of the shaft 6 following this path under the control of water pressure (FIG. 4). The design of the path 18 allows the movement of the piston part 4 in the chamber 5 to be determined and limit values to be set for the movement. The path 18 of the control mechanism 2 comprises in repetitive succession a lower position 1, an uppermost position 2, a lower position 3 and a second uppermost position 4. FIG. 4 shows a position 5 corresponding to position 1. The path 18 of the actuating mechanism has a design such that the pin 19 of the shaft 6 always follows the same order from position 1 to position 2, from position 2 to position 3, from position 3 to position 4 and from position 4 to position 5, which corresponds to position 1. In FIG. 4, position 3 is slightly above position 1, however, this is not essential for the invention. Positions 1 and 3 may be located at substantially the same level as well. The control mechanism 2 may also be some other mechanism than a cylinder in which a path has been formed, provided that the mechanism is such that achieves repeatedly varied vertical positions of the piston part 4.

When the water tank is ready for flushing, the water level 3 is on level with the sensor 11, the pins 7 and 8 are spaced by a distance determined by the control mechanism 2 (position 1 and 5 in FIG. 4). In rest position, the outlet pipe 9 is pressed tightly against the gasket 10 of the discharge valve and the inlet valve 12 is in closed position.

FIG. 2 illustrates the situation in the flushing step. When the water tank 1 is filled with water, the system is ready for flushing. The user presses for instance the flush button of the control unit 13. The inlet valve 12, preferably a solenoid valve, is opened for a preset period, the pressure of the water flowing into the chamber 5 is transmitted to the control mechanism 2, and the piston part 4 rises to the position 2 limited by the control mechanism, shown in FIG. 4. The counter-part 7 in the shaft 6 is pressed against the counter-part 8 of the discharge valve. The counter-part 8 transmits the vertical movement of the shaft 6 and the piston part 4 to the discharge valve 15, which then is opened and the water tank is emptied through the outlet pipe 9. The discharge valve 15 is open as long as the inlet valve 12 is open.

FIG. 3 illustrates the situation of filling the water tank. At the end of the set period, the inlet valve 12 is closed, and then the water under the collar-like piston part 4 is allowed to flow out from the chamber 5 through the gap 16 between the chamber bottom and the shaft 6 of the piston part. The piston part 4 is pressed into lower position, for instance under the force of gravity. This is illustrated by position 3 of the control mechanism in FIG. 4. At the same time, the counter-part 7 is pressed down, releasing the discharge valve 15, which moves down, closing the end of the outlet pipe 9. After this, the inlet valve 12 is reopened and the piston part 4 is lifted upwards under the effect of water pressure. The control mechanism 2 restricts the rising of the piston part 4 so that the counter-parts 7 and 8 do not coincide quite yet (FIG. 3). This is illustrated by position 4 in FIG. 4. Incoming water then flows from the inlet pipe 14 underneath the plate-like piston part 4 and passes through the gap between the piston part 4 and the chamber 5 and the gap 16 between the shaft 6 and the bottom of the chamber 5 into the water tank 1. As water fills the chamber 5, it flows from the chamber to the water tank 1 through an opening 17 or an overflow pipe 20 provided at the chamber cover or top. The inlet valve 12 stays open until the water level reaches the electric sensor 11. Then a signal from the sensor 11 to the control unit 13 closes the inlet valve 12 and the piston part 4 sinks back to the position 5 of FIG. 4, which corresponds to the position 1 of the endless path 18.

Should the user nevertheless wish to flush the bowl again during the filling stage, before the water tank has been filled all the way to the sensor 11, and presses the flush button, the inlet valve 12 is immediately closed. The piston part 4 in position 4 is lowered under the force of gravity and the control techniques move from one position 4 to another 5, corresponding to position 1. Then the control unit 13 automatically opens the solenoid valve 12, water flows under the piston part 4, and the control techniques allow the piston to rise into position 2, so that the counter-parts 7 and 8 coincide. Then the discharge valve 15 rises, the outlet pipe 9 opens, and the water having meanwhile gathered in the water tank is discharged, in other words, flushing takes place again. The opening period of the inlet valve 12 determines the desired amount of flush water.

The arrangement of the invention hence allows the user to flush the bowl once more without particularly long waiting intervals between the flushing cycles.

The figures and the related description are merely intended to illustrate the present invention. The flushing apparatus may vary in details within the scope of the inventive idea defined in the accompanying claims.

What is claimed is:

1. Apparatus for flushing a WC bowl or the like, comprising a water tank (1), an inlet valve (12), a discharge valve (15) and an actuating mechanism, the actuating mechanism comprising firstly a chamber (5) communicating with a water distribution system over an inlet pipe (14), a substantially vertical shaft (6) passing through the chamber bottom, a piston part (4) being connected inside this chamber, and secondly a part connected to the shaft (6) for generating a vertical movement of the shaft and the associated piston part, a counter-part (7) which is connected to the shaft (6) and is located at a location corresponding to the counter-part (8) of the discharge valve (15), and a device (11) for identifying the amount of water in the water tank and controlling the inlet valve (12), the amount of water used for flushing the bowl being controlled by means of an electrically driven inlet valve (12), which allows water to enter the chamber (5) through the inlet pipe (14) from the water distribution system, the water raising the piston part (4) and the shaft (6) in the chamber, the discharge valve (15) opening with the aid of the counter-parts (7, 8) and staying open until the inlet valve (12) is closed at the end of a period determined by a control unit (13) and the piston part (4) is pressed down under the force of gravity, after which the inlet valve (12) reopens, the water tank (1) refills and the control unit closes the inlet valve (12), characterized in that a part connected to the shaft (6) for generating the vertical movement of the shaft and the associated piston part (4) is a control mechanism (2) operating under the dynamic pressure of supply water.

2. An apparatus of claim 1, characterized in that the control mechanism (2) comprises a body in which a mechanical endless path (18) has been formed, a pin (19) located in the shaft (6) or any other projection following the path under a control of water pressure.

3. An apparatus of claim 2, characterized in that the path (18) comprises in repetitive succession a lower position 1, an uppermost position 2, a lower position 3 and a second uppermost position 4.

4. An apparatus of claim 3, characterized in that, at position 1 on the path (18), the apparatus is ready for flushing, the counter-part (7) attached to the shaft (6) and the counter-part (8) of the discharge valve (15) being spaced by a given distance determined by the control mechanism (2) and the inlet valve (12) being closed, at position 2, the counter-part (7) abuts against the counter-part (8) and the discharge valve (15) and the inlet valve (12) are open, at position 3 the counter-part (7) and the counter-part (8) are spaced by a given distance determined by the control mechanism (2), the discharge valve (15) and the inlet valve (12) are closed, at position 4 the counter-part (7) and the counter-part (8) are spaced by a given distance determined by the control mechanism (2), the discharge valve (15) is closed and the inlet valve (12) is open, and when the inlet valve (12) is closed, the cycle restarts from position 1 (or 5).

* * * * *